United States Patent [19]

Zeek

[11] 4,256,171

[45] Mar. 17, 1981

[54] REGENERATOR SEAL HUB GAS PASSAGES

[75] Inventor: Richard M. Zeek, Farmington, Mich.

[73] Assignee: General Motors Corporation, Detroit, Mich.

[21] Appl. No.: 9,107

[22] Filed: Feb. 5, 1979

[51] Int. Cl.[3] ..... F28D 19/00

[52] U.S. Cl. ..... 165/7; 165/9; 277/22

[58] Field of Search ..... 165/9, 7; 277/22

[56] References Cited

U.S. PATENT DOCUMENTS 3,192,998 7/1965 Chute ..... 165/9

*Primary Examiner*—Albert W. Davis

*Attorney, Agent, or Firm*—J. C. Evans

[57] ABSTRACT

A regenerator cross arm seal structure for a rotary regenerator of a gas turbine engine includes a cross arm seal extending diametrically of a matrix of the rotating regenerator which includes a center bore therein for a drive bushing and spindle; the seal having a leaf spring on one surface thereof that is engageable with an engine block support platform to seal between the engine block and one surface of a seal platform that supports a cross arm wear face with a hub section cooled by leakage of air through the center bore and the seal wear face including a material with low friction and good wear characteristics when operating at elevated temperatures between 1000° F. to 1500° F. (523° C. to 800° C.) and wherein the cooling effect of air leakage through the hub is counteracted by hot gas circulation through hot gas passages in the wear surface at the hub section thereof sized to allow pressure drop from the hot gas sides of the matrix to the cold gas side thereof to pump hot gas across the inboard seal assembly hub section to maintain it within a desired elevated temperature range for maintaining low friction and reduced wear thereon.

2 Claims, 4 Drawing Figures

REGENERATOR SEAL HUB GAS PASSAGES

This invention relates to cross arm seals for a rotary regenerator heat exchanger apparatus for gas turbine engines and more particularly to an inboard cross arm seal assembly with a center hub cooled by air leakage therethrough and heated by gas from a combustor assembly of a gas turbine engine.

The use of rotating heat exchangers or regenerators to recover exhaust gas is a common approach to increasing efficiency in vehicular gas turbine engines and the like. Such heat recovery is desirable since much of the operating mode of such vehicular gas turbine engines is during light duty operation at which time only a fraction of the rated power of a gas turbine engine is produced. A rotary regenerator is typically preferred to a fixed stationary recuperator form of heat recovery system since rotary regenerators offer a reduced size advantage and furthermore have a reduced pressure drop for a given value of heat transfer effectiveness. However, in such arrangements it is necessary to include regenerator matrix rubbing seal assemblies to avoid excessive flow leakage from the engine during its operation.

The examples of such prior art seal assemblies are set forth in U.S. Pat. Nos. 3,743,008, issued July 7, 1973, to Zeek Et Al for "Regenerator Seal" and also in 3,856,077, issued Dec. 24, 1974, to Siegla for "Regenerator Seal."

In such arrangements, the cross arm seal assemblies located on the cold and hot faces of the combustion gas flow paths through the matrix are operated in an elevated temperature region at which seal wear faces of graphite and other materials provide desirable low friction and reduced wear as the matrix surfaces rotate thereacross.

Such regenerators have a matrix bore at the center thereof that include a suitable drive bearing and spindle that rotatably supports the matrix for rotation with respect to an engine block support platform. In such arrangements, inlet air from the gas turbine engine compressor leaks into the center bore for the matrix support bearing and spindle and passes through the matrix and across hub sections of the cross arm seals so as to reduce the temperature of the wear face at the hub of the matrix and thereby affect desired low friction and wear resistance properties.

Accordingly, an object of the present invention is to provide an improved regenerator cross arm seal arrangement including an inboard seal assembly having a leaf spring engageable with a first engine block support platform, a seal support plate, and an inboard wear face element on the support plate that extends diametrically across the inboard surface of the rotating matrix seal between the air side and gas side of the matrix at the hot face thereof and further including an outboard seal assembly including a metal leaf seal in sealing engagement with an engine block support platform and including a seal support plate having a wear surface thereon in sealing engagement with the outboard face of the rotating matrix to seal between the air and gas passages of the matrix at the cold face of the matrix and wherein the inboard seal wear face has a hub section thereof cooled by transient cold air leakage through a center hub bore of the matrix including means for rotatably supporting the matrix with respect to both the inboard and outboard cross arm seal assemblies as well as with respect to the supporting engine block support platforms and wherein the inboard cross arm seal wear face is formulated from material having low friction and good wear resistance at elevated temperature ranges and wherein such properties are maintained by inclusion of means for producing a circulation of heated air with respect to hub sections of the seal wear faces to counteract cooling effects of air leakage through the center bore thereby to maintain an elevated temperature across the full inboard cross arm wear surface so as to maintain uniform friction and wear characteristics across the full length of the wear face of the regenerator inboard seal assembly to seal between the air and gas sides of the matrix.

Still another object of the present invention is to provide an improved gas turbine rotary regenerator assembly having a matrix with an air flow side and a gas flow side therein separated by an outboard and an inboard cross arm seal assembly and wherein the inboard cross arm seal assembly includes a wear face formulated from low friction and good wear resistance material at elevated temperature ranges and maintained in biased engagement with the hot face of the rotating matrix, the matrix having a center bore therethrough for receiving a support bushing and spindle for rotatably supporting the matrix for rotation with respect to an engine block and having cold air leakage through the hub region that cools the hub section of the inboard cross arm seal wear surface; the hub portion of the inboard cross arm wear surface includes a plurality of gas circulation grooves therein extending from the cross arm wear surface edge facing the gas side of the matrix to a point closely adjacent the inner wall of the bore through the matrix and wherein a like hub wear face section on the outboard seal is similarly grooved to define gas flow areas to produce a hot gas circulation through the matrix at a rate established by the pressure drop from the hot gas side of the regenerator disc to the cold gas side thereof as well as the flow area of the grooves to force sufficient flow of hot gas through the hub sections of the seal wear faces and the matrix disc to maintain the temperature of each of the wear surfaces of the seals at a uniform elevated temperature between the ends thereof to compensate for cooling effect of air leakage through the bore thereby to maintain an elevated operating temperature at the inboard cross arm wear face while avoiding excessive increase in temperature of the outboard cross arm wear face thereby to maintain a low friction and good wear resistance at elevated temperatures at the inboard seal cross arm assembly with reduction in wear without overheating the outboard cross arm wear.

These and other objects of the invention will be apparent from the following description, reference being had to the accompanying drawings wherein a preferred embodiment of the present invention is clearly shown.

Figure 1:
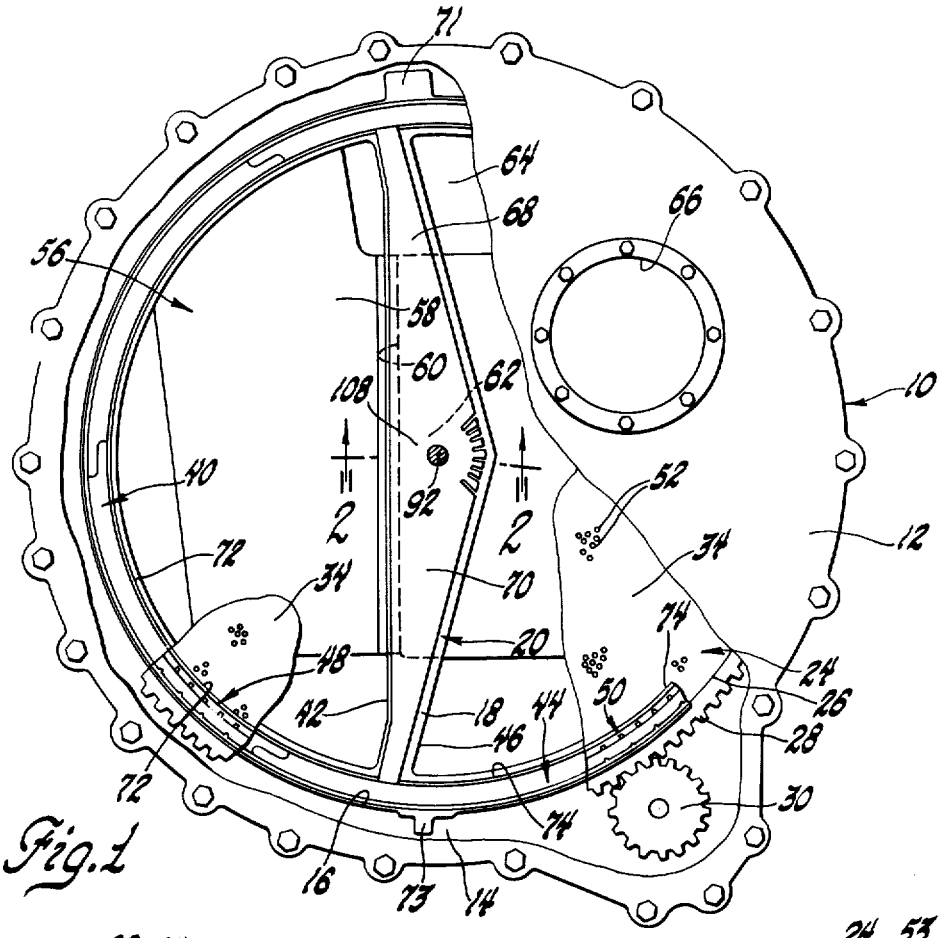
FIG. 1 is a side elevational view partially broken away of a rotatable regenerator assembly including the present invention.

Referring now to FIG. 1, a rotary regenerator assembly 10 includes a cover 12 on one side of an engine block 14. The block 14 includes an annular, undercut planar surface 16 therein to define a seal assembly support. Furthermore, the block 14 includes an integral cross arm 18 having an inboard cross arm seal assembly 20 formed thereacross to engage the hot side surface 22 of a regenerator disc 24 in the form of a circular matrix having an outer rim 26 thereon secured to an annular drive ring 28 that is meshed with a drive pinion 30 from a cross-drive assembly of the type set forth more particularly in copending United States Application, Ser. No. 831,616, filed Sep. 8, 1977, by Bell, for "Water Cooled Gas Turbine Engine now United States Patent No. 4,157,013, issued June 5, 1979."

An outboard cross arm seal assembly 32 engages the cold matrix surface 34 of the disc 24. It includes a platform 36, leaf spring seal 37 and seal wear face 38 connected thereto and engaged with cover 12 and surface 34, respectively. Examples of such an arrangement are more specifically set forth in above U.S. Pat. No. 3,856,077. Furthermore, a hot side air bypass rim seal assembly 40 is located on surface 16 on one side 42 of the inboard cross arm seal assembly 20 and a gas side bypass rim seal assembly 44 is supported by the planar surface 16 on the opposite side 46 of the cross arm seal assembly 20. Cold face air and gas side bypass rim seal assemblies 48, 50 are also shown fragmentarily in FIG. 1.

Thus, seal assemblies are provided between each of the hot and cold faces of the disc 24 and its housing as defined by cover 12 and block 14. Such seal assemblies are included to confine air and gas fluid flow paths through the matrix from an inlet space or opening 51 which receives compressed air from the outlet of a gas turbine engine compressor. The compressed air from the inlet opening 51 is directed through open ended pores or passages 52 in the disc 24. In one working embodiment, the matrix of disc 24 is fabricated from a metal or ceramic such as alumina silicate and has a cell wall thickness in the order of 0.008 cm, diagrammatically shown by the cell wall 53 of the fragmentary sectional view of FIG. 2.

The air flow from the opening 51 is heated as it flows through the rotating disc 24 and passes into a plenum 54 within the block 14 for a combustor can 56 where the compressed air is heated by combustion with fuel flow in the combustor can 56.

The combustor can 56 has an outlet transition 58 thereon connected to an inlet end 60 of a turbine nozzle 62 which supplies motive fluid to a gasifier turbine and a downstream power turbine as more specifically set forth in the aforesaid United States application, Ser. No. 831,616 of Bell.

Exhaust flow from the turbines enters through an exhaust passage 64 serving as a counterflow gas path to the hot side surface 22 of the matrix disc 24 on the opposite side of the cross arm seal assemblies 20, 32 from the inlet and plenun spaces 51, 54. The counterflow exhaust from passage 64 heats the matrix disc 24 as it passes through the passages 52 and thence is discharged through an exhaust opening 66 in the cover 12.

Each cross arm seal assembly 20, 32 includes two arms 68, 70 extending radially and somewhat diametrically of the matrix surfaces 22, 34 and joined together at the center of the matrix and joined at the outer rim of the matrix by the seal assemblies 40, 44, 48 and 50. All the assemblies are fixed by side tabs 71, 73 that interlock with block 14 or cover 12. Assemblies 40, 48 have an arcuate edge 72 thereon and associated components that extend around the high pressure inlet opening 51 and plenum space 54. The gas side bypass rim seal assemblies 44, 50 likewise include an arcuate inside edge 74 and associated parts that extend around the gas flow paths. The seal assembly components thus define an air path 76 therebetween for high pressure air flow and a gas path 78 therebetween for the low pressure exhaust gas flow from the gas turbine engines with these parts being best shown in FIGS. 1 and 2.

The cross arm seal arms 68, 70 extend between the high pressure and low pressure fluid paths 76, 78 and the seal assemblies 40, 44, 48, 50 seal the disc 24 adjacent to its outer periphery and to the block 14 and cover 12 for maintaining a pressure sealed relationship therebetween.

It has been observed that a desirable cross arm wear surface material against the hot side surface 22 of rotating disc 24 is a material which, run against a disc material, has a reduced wear rate at an operating condition of from 1000° F. to 1500° F. Hence both arms 68, 70 are made of three components: in the case of outboard cross arm seal assembly 32; leaf spring seal 37, platform 36 and seal wear face 38; and in the case of inboard case arm seal assembly 20, a leaf spring seal 80 in compressed sealing engagement with surface 16, a platform 82 and a seal wear face or surface 84.

Figure 2:
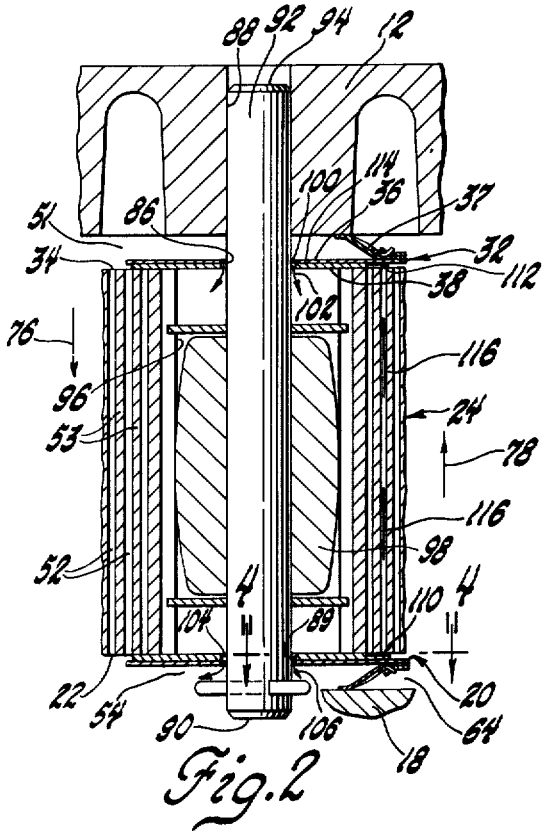
FIG. 2 is an enlarged, fragmentary sectional view taken along the line 2—2 of FIG. 1 looking in the direction of the arrows.
Figure 3:
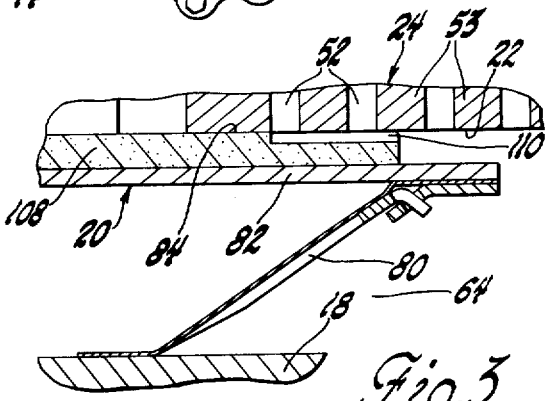
FIG. 3 is an enlarged, fragmentary sectional view of an inboard regenerator cross arm including the present invention.

As shown in FIG. 2, the outboard cross arm seal assembly 32 includes a central bore 86 formed therethrough which is axially aligned with a spindle support bore 88 in the cover 12. Likewise, the inboard seal has a central bore 89 therethrough through which the inboard end 90 of a spindle 92 is directed. The opposite end 94 of the spindle is supportingly received in the bore 88 for supporting the disc 24 for rotation with respect to the inboard and outboard cross arm seal assemblies 20, 32 which are fixed relative thereto as previously stated.

A central bore 96 is formed through the matrix 24 to receive the spindle 92. The bore 96 has a disc support bushing 98 supported therein for rotatably supporting the spindle 92 during rotation of the disc 24 by the drive pinion 30.

Figure 4:
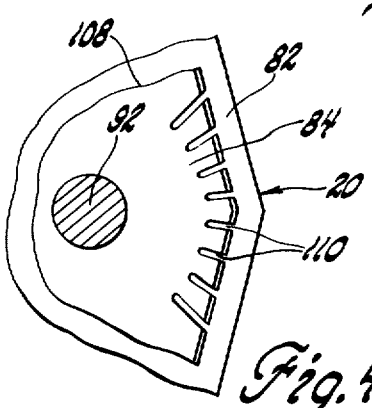
FIG. 4 is an enlarged fragmentary sectional view of an inboard cross arm seal hub taken along the line 4—4 of FIG. 2 looking in the direction of the arrows.

In such arrangements, colder air from the inlet opening 51 can migrate through a gap 100 formed between the wall of the seal assembly bore 86 and the outer surface of the spindle 92 as a downward flow of cold air as shown by arrows 102 through the matrix bore 96 which exits at a small annular gap 104 formed between the inboard cross arm seal assembly and the outer surface of the end 94 of the spindle 92 as best shown in FIG. 2. The exiting cold air flow, shown by the arrows 106, can cause an undesirable temperature reduction of the seal wear face 84 during gas turbine engine operation. More particularly, it has been observed that excessive cooling of the seal wear face 84 can cause it to have an increased friction as the hot face 22 passes thereacross and furthermore can reduce wear resistance of wear face 84. The effect is primarily concentrated in the region of a hub section 108 of the inboard seal wear face 84 as best shown in FIGS. 1 and 4. Prior attempts to alleviate this problem have included prevention of leakage of cold air into the bore 96 of the matrix disc 24. However, such structure can unduly complicate the hub drive system. Accordingly, the present invention compensates a leakage of cold air through the bore 96 as shown in FIG. 2 and provides a modified seal wear face hub section 108 to provide means for counteracting the effect of cold air flow thereacross. More particularly, the hub section 108 includes a plurality of outwardly formed grooves 110 that extend from the inboard edge of the wear face seal 84 that faces the hot gas flow path and a point immediately adjacent the inner wall of the matrix bore 96 as best shown in FIG. 2. These grooves are aligned with like grooves 112 formed in a center hub section 114 of the wear face 38. The grooves 112 are located in axial alignment with the grooves 110 on the opposite side of passages 52 in disc 24. The grooves 112 constitute outlets from the passages 52 that are opened to hot gas flow through the passages 110 which define inlets to a hot gas circulation path 116 which is formed closely adjacent the wall of the bore 96 at a point which would otherwise be sealed by the planar extent of both the seal wear face 84 of the inboard cross arm seal assembly 20 and the seal wear face 38 of the outboard cross arm seal assembly 32. The grooves 110, 112 are sized to provide a flow of hot gas pumped by the pressure differential from the exhaust gas passage 64 to the exhaust opening 66. The rate of hot gas flow through the circulation path 116 as shown in FIG. 2 is selected to counteract the cooling effect of the air flow 106 across the center hub section or region 108 of the seal wear face 84 so that the temperature of the seal wear face 84 will be maintained uniformly within an elevated temperature range of from 1000° F. to 1500° F. Yet, the grooves 110, 112 restrict gas flow to a level at which the hub section 114 of the outboard cross arm seal assembly will not be subjected to an excessive temperature rise to undesirably effect its wear and friction characteristics.

While the embodiments of the present invention, as herein disclosed, constitute a preferred form, it is to be understood that other forms might be adopted.

The embodiments of the invention in which an exclusive property or privilege is claimed are defined as follows:

1. A rotary regenerator comprising: housing means defining an air flow path and a gas flow path for air and gas at different pressure levels, an axial flow matrix with a hub including a center opening, said matrix also having open ended passages extending across the flow paths, said matrix having said open end passages pervious to fluid flow through the paths and including inboard and outboard radial surfaces, spindle means for rotatably supporting said matrix for rotation with respect to said housing, an outboard cross arm seal assembly interposed between the housing means and said outboard radial surface and including an outboard cross arm with a platform and wear surface extending between said flow paths for sealing therebetween, an inboard cross arm seal assembly including an inboard cross arm having a seal platform and a wear surface engageable with said inboard radial surface to seal between the flow paths at the inboard radial surface of the matrix, means including aligned bores in said outboard and inboard seal assemblies for defining an air circulation path for distribution of cold air from the air path to the outboard seal assembly through the center opening in said matrix and for distributing cold air through the matrix and in surrounding relationship to said spindle means, a center hub wear surface region of said inboard cross arm cooled by cooling air flow through one of said aligned bores, and heater means for reheating said center hub wear surface region to counteract the cooling effect of cooling air flow on said center hub wear surface region of said inboard seal assembly thereby to maintain a uniformly elevated temperature across the full planar extent of the inboard cross arm wear surface to optimize the operating temperature thereof during gas turbine engine operation so as to maintain low friction and wear characteristics between said last mentioned seal wear surface and the matrix.

2. A rotary regenerator comprising: housing means defining flow paths for air and gas at different pressure levels, an axial flow matrix with a hub including a center opening, said matrix also having open end passages extending across the flow paths, the matrix having said open ended passages pervious to fluid flow through the flow paths, said matrix including inboard and outboard radial surfaces with a pressure differential thereacross, spindle means for rotatably supporting said matrix for rotation with respect to said housing means, an outboard cross arm seal assembly interposed between the housing means and said outboard radial surface and including an outboard cross arm with a platform and wear surface extending between said flow paths for sealing therebetween, said outboard cross arm wear surface having a center hole wear surface region, an inboard cross arm seal assembly including an inboard cross arm having a seal platform and a wear surface engageable with said inboard radial surface to seal between the flow paths at the inboard radial surface of the matrix, means including aligned bores in said outboard and inboard seal assemblies for defining an air circulation path for distribution of cold air from the air path to the outboard seal assembly through the center opening in said matrix and for distributing cold air in surrounding relationship to said spindle means, a center hub wear surface region of said inboard cross arm cooled by cooling air flow through one of said aligned bores, and heater means for reheating said center hub wear surface region to counteract the cooling effect of cooling air flow on the center hub wear surface region of said inboard seal assembly to maintain a uniformly elevated temperature across the full planar extent of the inboard cross arm wear surface to optimize the operating temperature thereof during gas turbine engine operation so as to maintain low friction and wear characteristics between said last mentioned seal wear surface and the matrix, said heater means including undercut grooves in the center hub wear surface regions of the outboard and inboard wear surfaces on the side thereof facing the gas flow path, each of said grooves also facing and being open to said open ended passages in said matrix to pump hot gas from said inboard radial surface of said matrix into the matrix adjacent the central opening therein thence to the outboard radial surface of said matrix in response to said pressure differential thereby to direct a flow of hot gas through the undercut grooves in each of said inboard and outboard cross arms.

* * * * *